US010054346B2

(12) United States Patent
Cantadori

(10) Patent No.: US 10,054,346 B2
(45) Date of Patent: Aug. 21, 2018

(54) METHOD FOR CHECKING THE PRESENCE OF INCONDENSABLE GASES IN CLIMATE RECOVERY AND CHARGING STATION

(71) Applicant: BRAIN BEE S.P.A., Parma (PR) (IT)

(72) Inventor: Andrea Cantadori, Parma (IT)

(73) Assignee: MAHLE AFTERMARKET ITALY S.P.A., Parma (IT)

( * ) Notice: Subject to any disclaimer, the term of this patent is extended or adjusted under 35 U.S.C. 154(b) by 320 days.

(21) Appl. No.: 14/923,733

(22) Filed: Oct. 27, 2015

(65) Prior Publication Data

US 2017/0115042 A1 Apr. 27, 2017

(51) Int. Cl.
*F25B 45/00* (2006.01)

(52) U.S. Cl.
CPC ..... *F25B 45/00* (2013.01); *F25B 2345/001* (2013.01); *F25B 2345/002* (2013.01); *F25B 2345/003* (2013.01); *F25B 2345/005* (2013.01)

(58) Field of Classification Search
CPC ..... F25B 2345/001; F25B 2345/002; F25B 2345/003; F25B 2345/005; F25B 45/00
USPC ..... 62/149
See application file for complete search history.

(56) References Cited

U.S. PATENT DOCUMENTS 3,686,954 A * 8/1972 Motl ..... G01M 13/00 116/220
4,285,206 A * 8/1981 Koser ..... B60H 1/00585 62/126
4,539,817 A * 9/1985 Staggs ..... B60H 1/00585 62/149
4,909,042 A * 3/1990 Proctor ..... B60H 1/00585 62/149
5,005,369 A 4/1991 Manz
5,067,327 A * 11/1991 Leblanc ..... F25B 45/00 141/82
6,134,899 A 10/2000 Brown et al.
6,244,055 B1 * 6/2001 Hanson ..... B60H 1/00585 62/149
6,260,378 B1 * 7/2001 Sagar ..... F25B 43/043 62/149
7,854,130 B2 * 12/2010 Brown ..... B60H 1/00585 62/149

(Continued)

FOREIGN PATENT DOCUMENTS

EP 2529961 A1 12/2012
EP 2591929 A3 5/2013

*Primary Examiner* — Henry Crenshaw
(74) *Attorney, Agent, or Firm* — Pearne & Gordon LLP

(57) ABSTRACT

Method of determining the presence of incondensable gases in a climate station cylinder for recharging motor vehicle air conditioning systems. One of the pressure sensors will be used that is present in the charging station and designed for monitoring the operations in the A/C system of the vehicle, placed on the low pressure LP and/or high pressure HP lines of the climate station, so that in case of verification of the incondensable gases, the control electronics opens a coolant charging valve and an HP/LP separating valve, thereby flooding the service pipes so as to receive the pressure signal from one of the service pressure sensors, LP or HP, of the station, and compare the value with the temperature T of the cylinder and check whether such pair of values is a corresponding parameter, without tolerances, of a pressure-temperature curve of the pure coolant.

2 Claims, 3 Drawing Sheets

(56) References Cited

U.S. PATENT DOCUMENTS

| | | | | |
|---|---|---|---|---|
| 2001/0000050 | A1* | 3/2001 | Okazaki | F25B 25/00 62/149 |
| 2006/0137366 | A1* | 6/2006 | Kang | F25B 45/00 62/149 |
| 2012/0031116 | A1* | 2/2012 | McMasters | F25B 45/00 62/77 |

* cited by examiner

METHOD FOR CHECKING THE PRESENCE OF INCONDENSABLE GASES IN CLIMATE RECOVERY AND CHARGING STATION

SCOPE OF THE INVENTION

The present invention relates to automotive climate stations, particularly for use in repair shops, coolant recovery and recharging stations for air conditioning in motor vehicles. As used herein, coolant means refrigerant.

BACKGROUND ART

Air conditioning systems in motor vehicles are subject to coolant leakage and require periodic refills. It is therefore necessary to carry out a system recharge and/or regeneration; to this end, devices have been developed for maintenance of air conditioning systems able to carry out the recovery, recycling and recharging of the coolant inside the system itself.

In the charging techniques of air conditioning systems for motor vehicles, the control of the so-called "incondensable" gases, i.e. gases which cannot be liquefied at ordinary temperature and pressure, takes on considerable importance. In practice this is air whose presence, in solution (in liquid or vapor phase) with the coolant gases (R-134a and R-1234yf are those currently universally used by the industry) causes some drawbacks described below.

As seen in FIG. 1, the presence of incondensable gases increases the liquid-vapor equilibrium pressure of the coolant: in fact, this pressure in the pure coolant is equal to the vapor pressure of the coolant itself and increases with increasing concentration of incondensable gas according to Dalton's law. The pressure rise in the A/C system in operation translates into a reduction of the COP of the compressor, i.e. a reduction of yield and thus a higher fuel consumption: intuitively, this is because air participates very marginally in the refrigerating cycle, as it does not change state during a cycle of an A/C system for automotive use, and because the compressor must compress the coolant-air mixture at higher pressures than it would with pure coolant.

The amounts of air are still very limited: on average, they are parts per million (ppm), since the air enters just as undesired component through repeated connection/disconnection cycles of the service fittings of the A/C system. In fact, every A/C system for automotive use is provided with two connectors, as will apparent from the following description, called service ports: one for the high pressure (HP) side and one for the low pressure (LP) side. Such ports, and the corresponding fittings supplied to the recharging stations, are regulated by the SAE J3639 standard.

During normal use, a dead space remains for each fitting of the quick coupling on the corresponding port in which the ambient air is trapped and then recovered by the station through the coolant. Typically, there are 2 cubic centimeters of air (about 2 milligrams) for systems with a capacity of about 500 grams, i.e. 4 ppm. This amount of air remains mostly dissolved in the vapor phase of the storage cylinder of the charging station; since the A/C system charging takes place by taking coolant from the liquid phase in the storage cylinder, most of the air is not returned to the system. A progressive accumulation of air thus occurs, to the point that a significant fraction may also be present in the liquid phase, thus "polluting" the A/C system.

In addition to the above, it should also be noted that one or more incorrect operations by the operator of the charging system may cause an accidental suction of ambient air by the station.

For this reason, the SAE J2099 standard details some requirements of purity of the coolant used for charging: the charging stations must ensure that the gas used for charging contains not more than 150 ppm air by weight.

The prior art used to monitor the presence of incondensable gases involves the measurement of temperature T and pressure P of the storage cylinder inside the climate station. When the station is inactive (but obviously switched on, so that the control electronics can implement the algorithm described hereinafter), the software checks that the coordinate pair (P, T) is on the liquid-vapor equilibrium line of the pure coolant (shown in FIG. 3). If the measured pressure is higher than what it should be at temperature T, there are incondensable gases and through a special valve on top of the cylinder, the same is "purged", i.e. a vapor phase that (at least in theory) consists primarily of air (a stratification occurs, since air is lighter than the coolant vapor, as shown in FIG. 5) is vented.

Said technique has the main drawback of requiring a dedicated pressure sensor on the cylinder, which is generally expensive and, more importantly, is used only during "maintenance" operations of the coolant: typically, the need for air bleeding occurs once every two weeks, rarely more often.

DESCRIPTION AND ADVANTAGES OF THE INVENTION

The object of the present invention is to provide an improved climate station, i.e. that equally allows the presence of any incondensable gas inside the cylinder to be determined and possibly proceed to the bleeding thereof, with a simple, rational and quite cost-effective solution.

These and other objects are achieved with the features of the invention described in the independent claim 1. The dependent claims describe preferred and/or particularly advantageous aspects of the invention.

In particular, an embodiment of the present invention provides that the climate station does not have a dedicated cylinder/tank pressure sensor, and that at least one of the one or more sensors (such as LP) already present in the charging station is used through the onboard electronics, i.e. the dedicated sensors for monitoring the operations in the A/C system of the vehicle arranged on the low and high pressure (LP, HP) lines of the climate station.

In particular, an embodiment of the present invention provides that in the station thus configured, when the control electronics is required to proceed with checking the incondensable gases, said electronics is configured to control the opening of the coolant valve and an HP/LP separation valve, which is a normally closed valve which keeps the high and low pressure lines separate.

In this way, the coolant in liquid phase reaches the service pipes and comes into contact with the low pressure sensor, i.e. the service sensor of the station provided to monitor the progress of the coolant recovery and charging operations.

At this point, the electronics picks up and takes into account the temperature T signal received from the cylinder and said pressure P of the low or high pressure line, and checks that the pair of coordinates (P, T) is on the liquid-vapor equilibrium line of the pure coolant (shown in FIG. 3). If not, i.e. if the measured pressure is higher than what it should be at temperature T, it means that there are incondensable gases: through a special valve on top of the cylinder, the same is "purged", i.e. a vapor phase that consists primarily of air (a stratification occurs, since air is lighter than the coolant vapor) is vented.

If the incondensable gases need to be discharged, the control electronics proceeds with bleeding by operating the solenoid valve connected to the station tank until the pair (P, T) returns on the pressure-temperature curve of the pure coolant.

At the end of the above check and relative operations, the coolant filling valve is closed and the gas present in the pipes is recovered and introduced back in the cylinder.

By this solution, the advantage obtained was maintaining the incondensable gas venting feature at a significantly lower cost, since no dedicated pressure sensor for the cylinder is used. In contrast, the flooding and subsequent emptying of the pipes typically requires a penalty of 1-2 minutes, absolutely negligible considering that the draining of incondensable gases is typically required not more often than every two weeks.

Said objects and advantages are all achieved by the climate station for charging and recovery systems of motor vehicles with incondensable gas control system and method thereof, object of the present invention, characterized by that provided in the following claims.

BRIEF DESCRIPTION OF THE FIGURES

This and other features will be more apparent from the following description of some of the embodiments, illustrated purely by way of example in the accompanying drawings.

DESCRIPTION OF THE INVENTION

The present invention will now be described in detail with reference to the accompanying drawings to enable a man skilled in the art to implement and use it. Various modifications to the embodiments described will be immediately apparent to the man skilled in the art.

Figure 1:
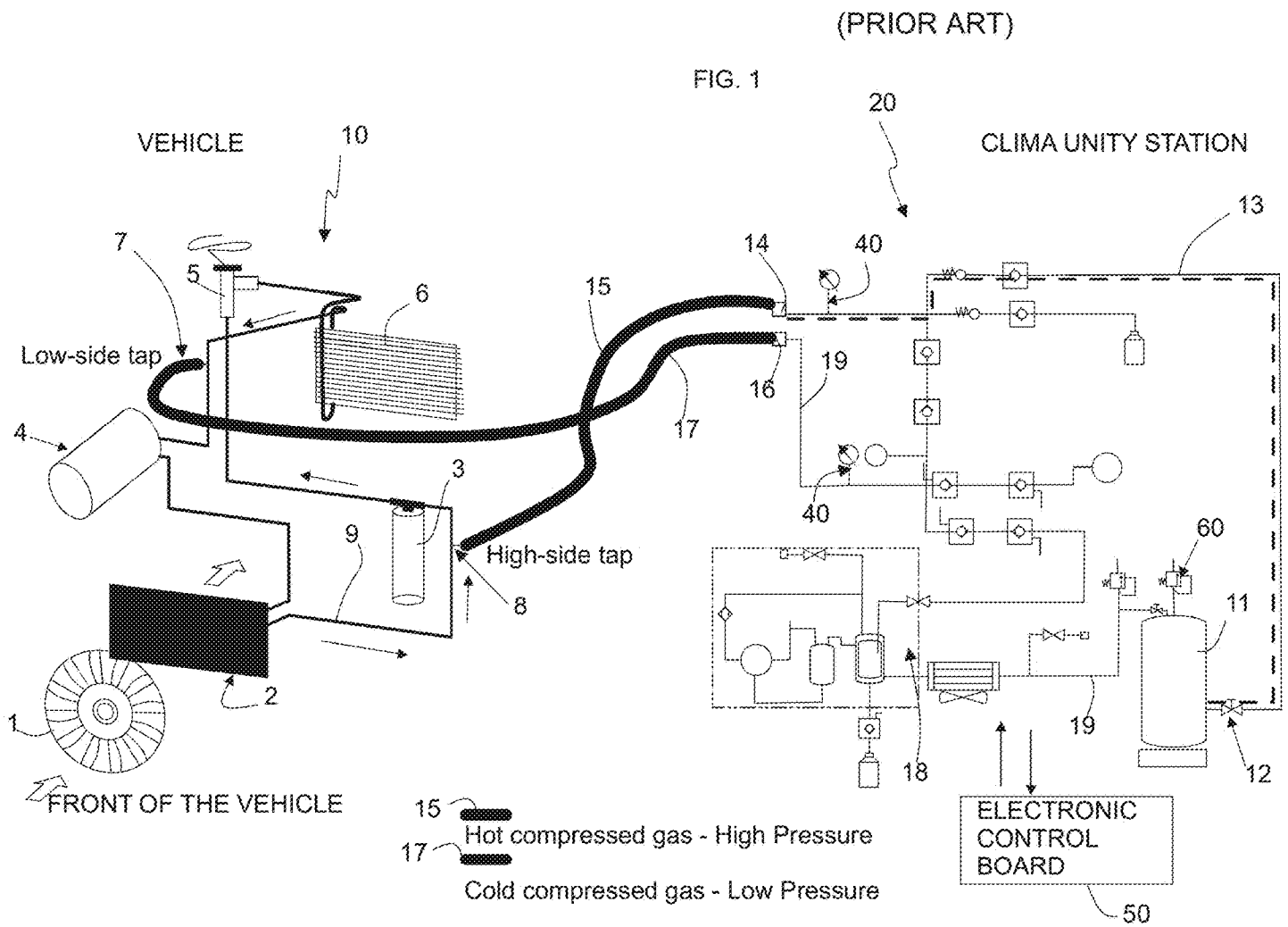
FIG. 1: generically shows a circuit diagram for connecting a charging station to the air conditioning system of a motor vehicle.

With reference to FIG. 1, reference numeral 10 indicates an air conditioning or climate control system in a motor vehicle; it is installed in a vehicle and comprises a refrigeration circuit within which a coolant gas of predetermined type circulates at low pressure.

The main components in said system 10 are:

a compressor 4;

a condenser 2 and a ventilation system 1;

at least one coolant storage and dryer filter 3, an expansion valve 5;

an evaporator 6.

The compressor is the component designed to generate the pressure difference, a difference that allows the cycle to be repeated: in fact, it pumps the coolant fluid through the evaporator, where it evaporates at low pressure by absorbing heat from the outside, then compresses it and pushes it inside the condenser, where it condenses at high pressure by releasing the previously absorbed heat to the outside. The coolant fluid changes state inside the two heat exchangers: in the evaporator it changes from liquid to gaseous, in the condenser it changes from gaseous to liquid.

The motor vehicle air conditioning system 10 also has two external terminals/connectors 7, 8 in low pressure (external low pressure connector) and high pressure (external high pressure connector), respectively, through which it is possible to recharge and/or recover the coolant gas through the connection with corresponding coupling devices of the climate station, or A/C station, in order to carry out the maintenance and recharge operations and other necessary checks.

Figure 2:
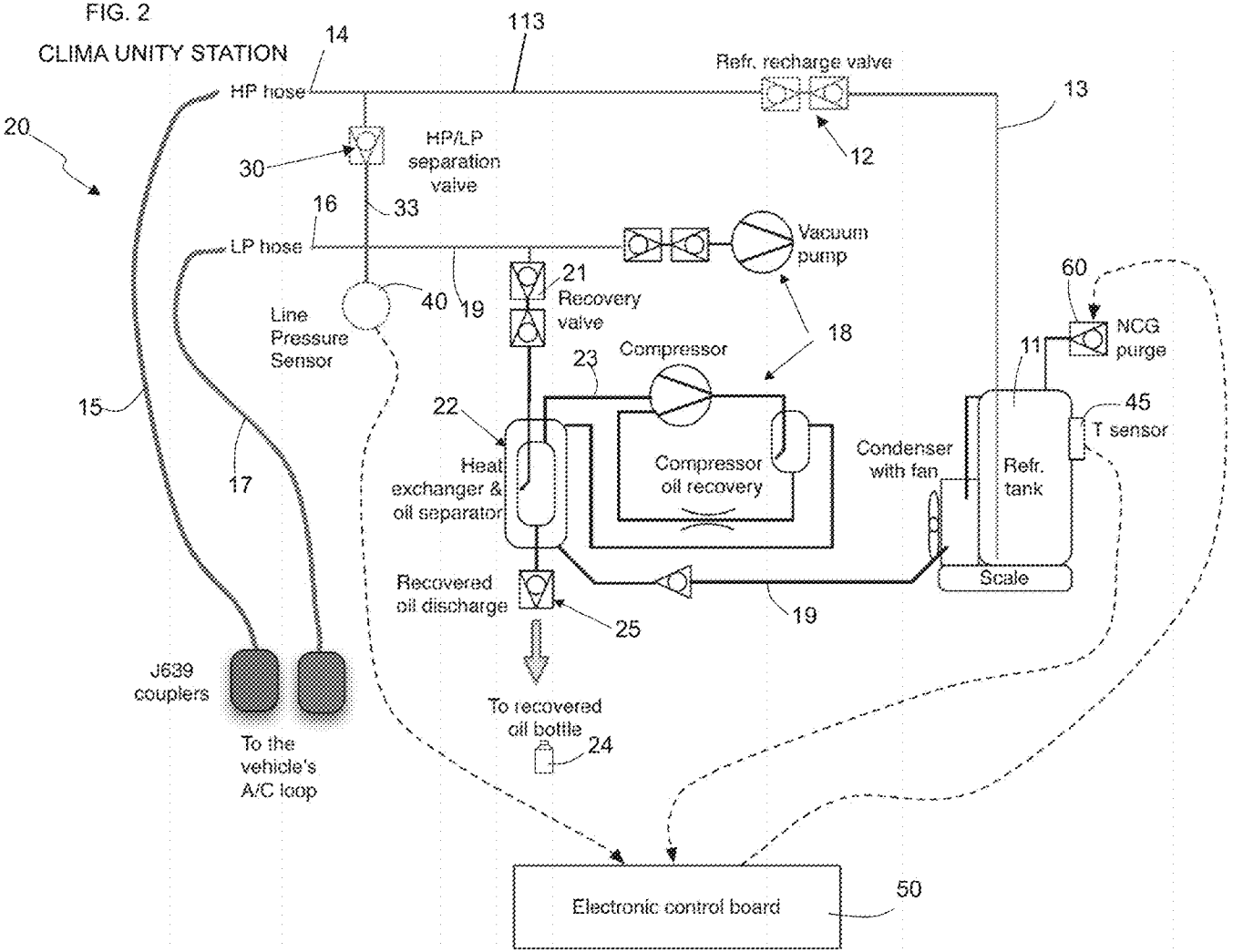
FIG. 2: shows in detail the circuit diagram of an A/C charging station for motor vehicles, comprising a system configured to carry out the oil recovery as provided by the invention.

Again with reference to FIG. 1 and now also to FIG. 2, reference numeral 20 indicates a climate recovery and charging station comprising at least the following components:

a coolant tank 11, or cylinder, a shut-off solenoid valve 12 for opening and closing at least one coolant fluid outlet pipe 13, HP, i.e. high pressure, connection, indicated with reference numeral 14, connectable in the respective high pressure branch 15 to the conditioning system 10, so as to be connected to the high pressure liquid coolant through the fitting/valve 8;

an LP, i.e. low pressure, connection is also provided, which is identified by reference numeral 16, and connectable through the corresponding branch 17 to the conditioning system, in the fitting indicated with reference numeral 7 generally placed after the expansion valve; the coolant is in a gaseous state and at low pressure;

a suction unit 18 that, through a compressor element, sucks/extracts the coolant from the conditioning system of the vehicle and sends it to tank 11 through pipes 19, so as to drain the system, a separation valve 30 of high and low pressure lines, a pressure sensor 40 on at least one of said high and low pressure lines, a temperature sensor 45 integral with, or alternatively mounted in the proximity of, said tank (11) for measuring said parameter, a solenoid valve 60 for draining the incondensable gas from the tank, at least one control and data processing unit/card 50 configured with said elements so as to receive the values thereof and manage the recovery, recharge steps and the operations required to implement the present invention.

Substantially, once connected to the air conditioning system, the climate station carries out the following operations:

The recovery of the coolant fluid present in the conditioning system, through the pipes for connection to the system of vehicle 15 and 17 and the respective valves 7 and 8;

The filtering of the coolant fluid recovered;

The injection of coolant fluid in the air conditioning system, on the high pressure HP valve side.

Systems of the measurement of the mass associated with the tank may be provided, so as to monitor both the amount of coolant fluid recirculated and the amount subsequently injected in the air conditioning system.

Further devices or features may be implemented in the control logic and the configuration of the processing and management unit of station 20, without departing from the scope of the present invention which, as said, relates to a procedure configurable in the control unit of station 20 capable to implement and allow full recovery of the oil at the end of the coolant recovery for its subsequent re-introduction during charging of system 10.

The climate station 20 of the present invention, contrary to the stations of the prior art, is not provided with any pressure sensor connected to tank 11.

The presence of valve 30 along with the operating logic of the control unit of station 20 allows determining the presence of incondensable gases inside the cylinder and possibly purging them, with a saving in terms of costs of the station while maintaining adequate reliability.

The control unit 50 is in fact configured to operate without a dedicated pressure sensor on tank 11, which as said would be used only upon switch-on in order to assess the presence of incondensable gases in said tank.

The control unit 50 instead uses one of the sensors (such as LP) already present in the charging station for monitoring the operations in the A/C system of the vehicle (it is in fact necessary to have one or two sensors on the LP and HP lines of the station in order to carry out a recovery cycle, since without the information relating to pressure in the system it is not possible to know when the recovery has finished).

Figure 3:
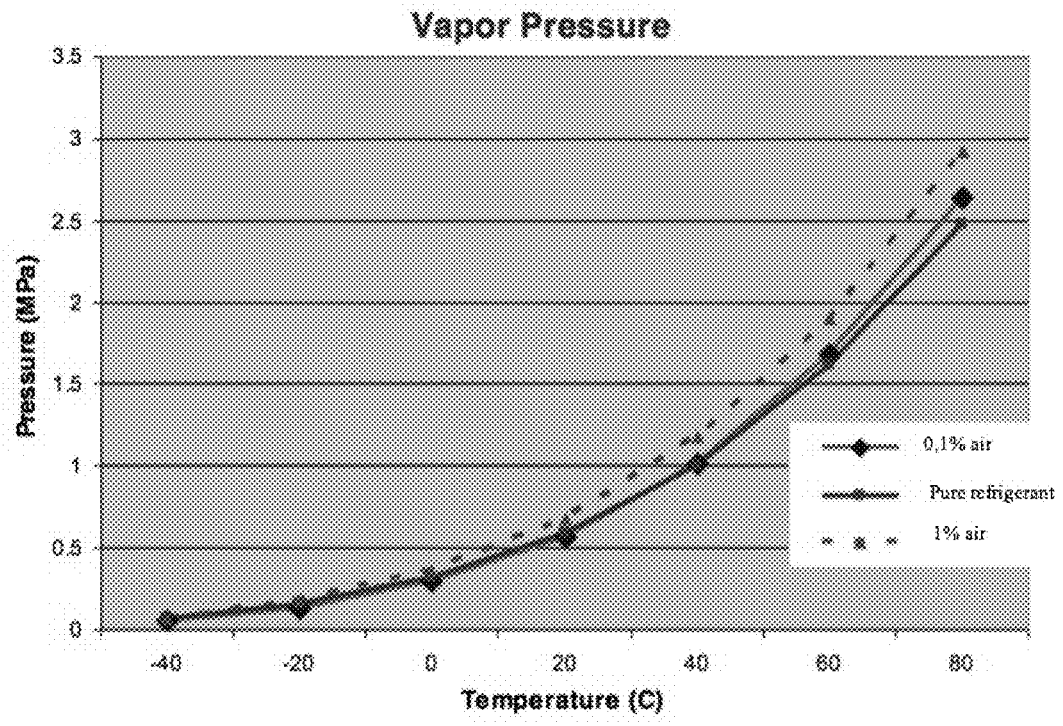
FIG. 3: shows the pressure-temperature chart of the pure coolant.

The method implemented by the control logic and configured in unit 50 is schematically shown with particular reference to FIG. 3, which shows the diagram of a typical low cost service station, i.e. provided with only one pressure sensor 40 on the LP line indicated with reference numeral 19.

In essence, when the electronic control unit 50 wants to proceed to the verification of the incondensable gases—generally when switching on station 20 or at preconfigured time intervals on the same control unit, unit 50 opens the coolant charging valve 12 and valve 30 of separation of lines 19 and 30 (HP/LP), and makes the pure coolant flow from tank 11 and in liquid phase to the service pipes now configured as a closed circuit (indicated with reference numerals 19, 13 and 33); in this way, the fluid comes into contact with the low pressure sensor LP, that is, the sensor indicated with reference numeral 40 and serving the station, provided to monitor the progress of the coolant recovery and recharging operations.

At this point, unit 50:

Considering the temperature value T arriving from a dedicated temperature sensor 45 connected to tank 11 and Considering the pressure value measured by sensor 40 when the circuit is closed by valve 30 and line 33, Checks that the pair of pressure-temperature coordinates (P in 40, T 45) corresponds to that of the liquid-vapor equilibrium line of the pure coolant, an example of which is shown in FIG. 3.

Figure 4:
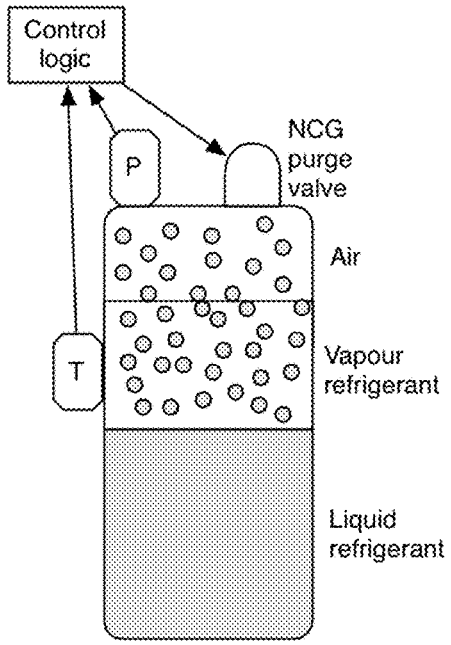
FIG. 4: shows the stratification inside the tank of the climate station.

If such a coordinate pair does not correspond to that of the pure coolant line, that is, if the pressure measured by sensor 40 is greater than what it should be at temperature T, it means that there are incondensable gases and through the appropriate valve 60 on top of tank 11, they are "purged", allowing an outflow of vapor phase which is mostly made up of air—in fact, since air is lighter than the coolant vapor, stratification occurs as shown in FIG. 4.

The opening of said valve 60 continues until the pressure-temperature pair (P in 40, T in 45) returns on the pressure-temperature curve of the pure coolant.

At the end of the operations, the coolant charging valve 12 is closed and the gas present in lines 33, 19, 13 is recovered and then fed back into tank 11.

At this point, the station is free of incondensable gases and the maintenance operations of the air conditioning system of the motor vehicle can be carried out.

In this way, the advantage obtained was maintaining the incondensable gas venting feature at a significantly lower cost, since no dedicated pressure sensor for the cylinder is used. In contrast, the flooding and subsequent emptying of the pipes typically requires a penalty of 1-2 minutes, absolutely negligible considering that the draining of incondensable gases, as mentioned, is typically required not more often than every two weeks.

In essence, the method for the verification of the presence of incondensable gases in a climate charging station 2 determines the presence of incondensable gases inside tank 11 of station 20 using one of the LP or HP sensors present in the charging station 20 and adapted to monitor the recovery and recharge of the A/C system of the vehicle; the control unit 50 opens at least one coolant charging valve and at least one valve of separation of the HP/LP lines, forming a closed circuit so that the coolant in the liquid phase and from tank 11 floods the service pipes 13, 19, 33 and comes into contact with the service pressure sensor 40 of station 20 which, connected to said unit 50, communicates the corresponding value thereof; as a function of said pressure and temperature value measured on tank 11, the unit processes and verifies the presence of incondensable gases.

The invention claimed is:

1. Method for checking the presence of incondensable gases in a coolant contained inside a tank (11) of a climate recovery and charging station (20) for an air conditioning system (10) of a motor vehicle, said climate recovery and charging station (20) comprising a low pressure line (19) with a low pressure connection (16) that is connectable to an external low pressure connector (7) of the air conditioning system (10), a high pressure line (113) with a high pressure connection (14) connectable to an external high pressure connector (8) of the air conditioning system (10) and a pressure sensor (40) arranged on the low pressure line (19) and/or the high pressure line (113) and used to monitor the recovery and charging operations of the air conditioning system (10), said method comprising a step of measuring the temperature (T) of the coolant by a temperature sensor (45) integral with or mounted in proximity of said tank (11), wherein said method uses a control unit (50) that is configured to:

open at least one shut-off solenoid valve (12) of an outlet pipe (13) connected to said tank (11) and open at least on separation valve (30) that is arranged on a branch line (33) between the low pressure line (19) and the high pressure line (113) so as to form a closed circuit (13, 113, 33, 19), once the circuit has been formed the coolant flows from the tank (11) through the outlet pipe (13), the high pressure line (113), the branch line (33), the low pressure line (19) and comes in contact with said pressure sensor (40) that measures the pressure (p) of the coolant, the control unit (50) checking whether the pair of pressure-temperature coordinates (p, T) detected from said pressure sensor (40) and from said temperature sensor (45) is on a liquid-vapor equilibrium line of said coolant, if the measured pressure (p) is higher than what it should be at the measured temperature (T) it means that there is a presence of incondensable gases within the coolant.

2. Station (20) for recovering and recharging coolant fluid from an air conditioning system (10) of a motor vehicle, with control unit (50) configured to operate according to the method set out in claim 1.

* * * * *